United States Patent [19]

Calderon

[11] 4,142,942

[45] * Mar. 6, 1979

[54] METHOD AND APPARATUS FOR QUENCHING COKE

[76] Inventor: Albert Calderon, 1065 Melrose Dr., Bowling Green, Ohio 43402

[ * ] Notice: The portion of the term of this patent subsequent to Aug. 3, 1993, has been disclaimed.

[21] Appl. No.: 724,162

[22] Filed: Sep. 17, 1976

Related U.S. Application Data

[63] Continuation-in-part of Ser. No. 479,461, Jun. 14, 1974, Pat. No. 3,972,780, which is a continuation-in-part of Ser. No. 454,169, Mar. 25, 1974, abandoned, which is a continuation of Ser. No. 283,427, Aug. 24, 1972, abandoned, which is a continuation of Ser. No. 14,268, Feb. 26, 1970, Pat. No. 3,645,854.

[51] Int. Cl.[2] ..... C10B 97/12

[52] U.S. Cl. ..... 201/39; 202/263; 202/227

[58] Field of Search ..... 201/39, 40; 202/262, 202/263, 227–233; 98/115 VH

[56] References Cited

U.S. PATENT DOCUMENTS

| | | | |
|---|---|---|---|
| 3,367,844 | 2/1968 | Cremer | 202/227 |
| 3,547,782 | 12/1970 | Schon | 202/263 |
| 3,721,609 | 3/1973 | Spindeler | 202/263 |
| 3,766,018 | 10/1973 | Riechert | 202/227 |
| 3,809,619 | 5/1974 | Drebes et al. | 201/39 |
| 3,972,780 | 8/1976 | Calderon | 202/227 |

*Primary Examiner*—Hiram H. Bernstein

[57] ABSTRACT

An improvement made to quenching coke during the push wherein the coke is physically opened for increased exposure to the quenching medium.

4 Claims, 12 Drawing Figures

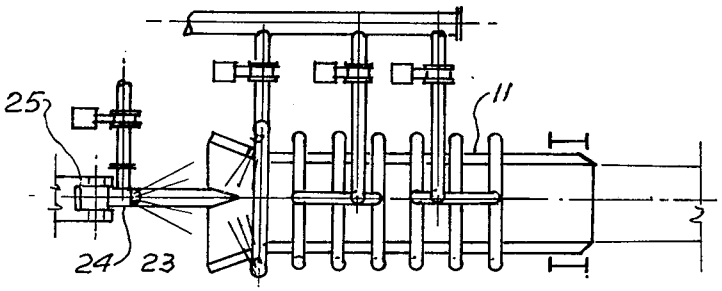
FIG. 6
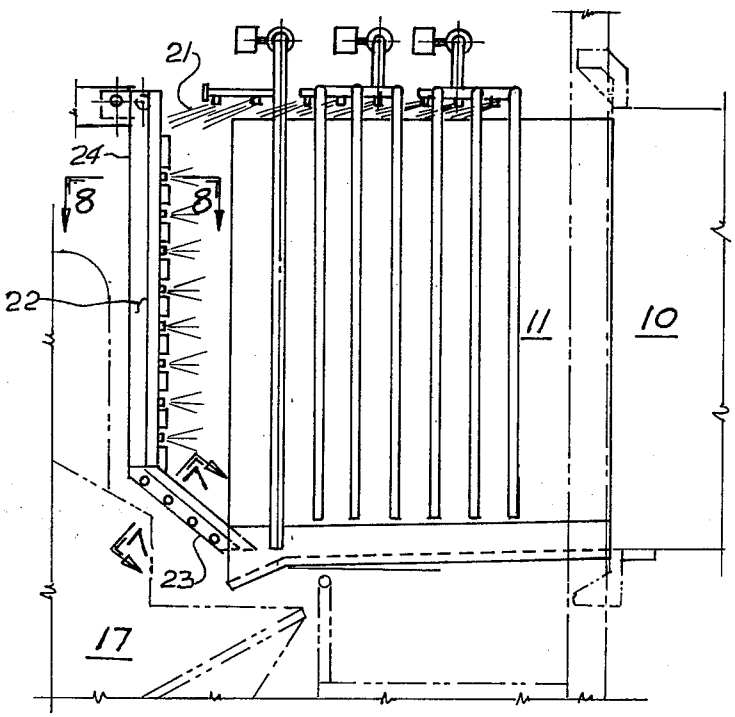
FIG. 5
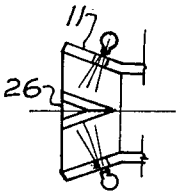
FIG. 10
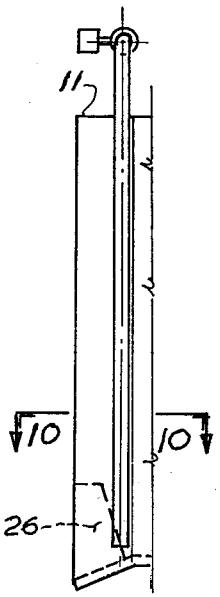
FIG. 9
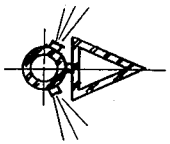
FIG. 7
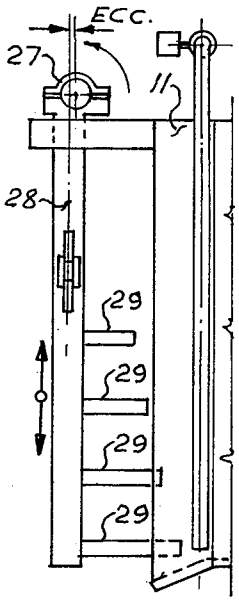
FIG. 11
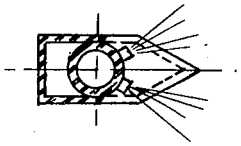
FIG. 8
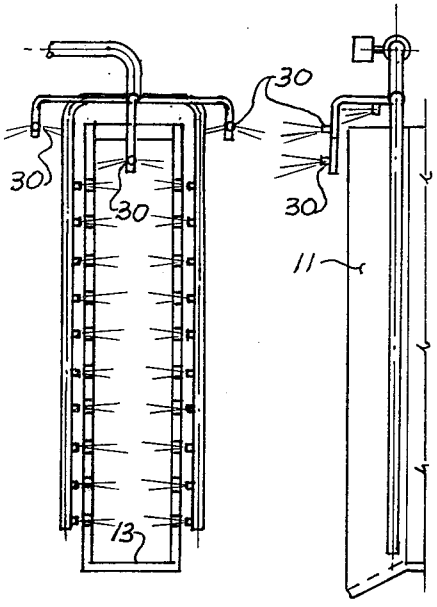
FIG. 12
FIG. 13

METHOD AND APPARATUS FOR QUENCHING COKE

The present application is a continuation in part of applicant's patent application Ser. No. 479,461, filed June 14, 1974, (now U.S. Pat. No. 3,972,780), and a continuation in part of applicant's patent application Ser. No. 454,169, filed Mar. 25, 1974, (now abandoned), which is a continuation of application Ser. No. 283,427, filed Aug. 24, 1972 (now abandoned and which is a continuation of application Ser. No. 14,268, filed Feb. 26, 1970, now U.S. Pat. No. 3,645,845.

The present invention relates to an improved method and apparatus for quenching coke during the push.

The efficiency in quenching was found to increase by exposing additional surface of the coke by means of the physical separation of the coke such as the bisection or biforcation caused by a plow, a cleaver, a mechanical vibrator or the like means, to open up the coke before emerging from the exit end of the guide through which the coke is pushed.

The instant improvement has for its main object the separation of the coke to increase its exposure to the cooling medium in order to result in a more efficient manner of dropping the temperature of the coke during the push before its falling onto a conveyance means.

Another object of the instant invention is to provide a means to prevent water from flowing into the oven being pushed during the quenching.

Further another object of the instant invention is to bisect the coke by means of a plow and expose each of the bisected branch to maximum exposure to the cooling medium.

Yet another object of the instant invention is to provide a partial vertical plow at the exit end of the guide through which the coke is being pushed to break up the cake of coke and open up the body of coke for an increased exposure to the cooling medium.

It is another object of the instant invention to have said plow extend vertically so that the complete body of coke is severed at the cleavage of the coke in order to increase its exposure to the cooling medium.

It is yet another object of the instant invention to cause the body of coke to separate and open up for an increased exposure to the cooling medium, the separation and opening up being accomplished by means of a vibratory element.

It is further another object of the instant invention to diverge the sides of said guide adjacent to said bisecting plow in order to minimize any binding action upon the body of coke being pushed.

Still another object of this invention is to slope the bottom of said coke guide to enhance the pushing action of said coke as well as direct excess water away from the oven being pushed.

It is still another object of this invention to provide suppression sprays on top of said guide in order to help suppress particulate matter.

Further still, another object of this invention is to provide suppression sprays at the end of said guide in order to help suppress particulate matter from the vapor rising from said conveyance means which received the cooled coke.

Other objects of this invention will appear from the following detailed description and appended claims.

Reference is made to the accompanying drawings forming a part of this specification wherein like reference characters designate corresponding parts in the views.

BRIEF DESCRIPTION OF DRAWINGS

FIG. 5 shows a side elevation of the guide with cleavage means in combination with a plow to separate the coke as it emerges from the guide in order to maximize surface exposure for efficient cooling. It also shows suppression sprays for abatement of particulate matter.

FIG. 6 is a plan view of FIG. 5 showing the means of separating the coke at the exit end of the guide, equipped with pivot means; cut out means are provided to permit the plow to swing away from the guide in the event the back pressure on the body of coke is excessive.

FIG. 7 is a section of the plow taken at 7—7 of FIG. 5.

FIG. 8 is a section taken at 8—8 of FIG. 5.

FIG. 9 is a variation of plow means for separating the coke.

FIG. 10 is a section taken at 10—10 of FIG. 9.

FIG. 11 is a variation of the plow for separating the coke. This variation taking the shape of an eccentric to physically break up and open the coke for additional exposure.

FIG. 12 is a partial side view of the end of the guide showing suppression sprays for abatement particulate matter from the vapor created by the quenching action.

FIG. 13 is a front elevation of FIG. 12.

Figure 3:
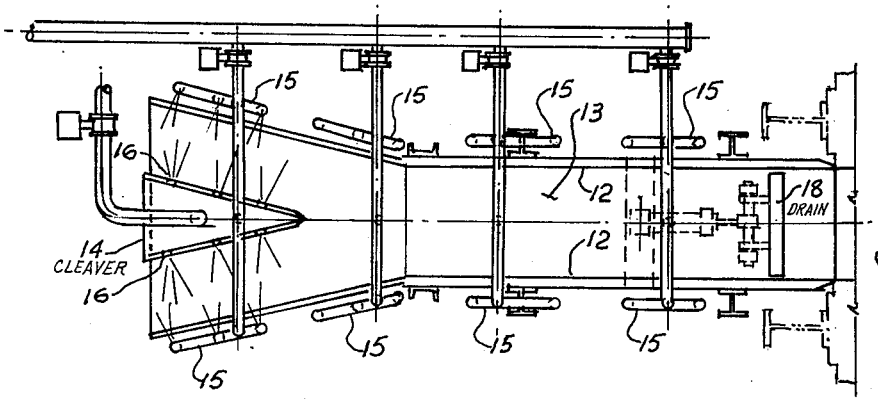
FIG. 3 is a plan view of FIG. 1. It shows the guide positioned against the oven being pushed and the plow means to sever the coke and expose it to maximum surface for a greater efficiency in cooling.

Before explaining in detail the present invention, it is to be understood that the invention is not limited to its application and to the details of construction and arrangement of the parts illustrated in the accompanying drawings since the invention is capable of other embodiments. Also, it is to be understood that the phraseology or terminology herein is for the purpose of description and not limitation.

DETAILED DESCRIPTION OF DRAWINGS

In the drawings 10 indicates the oven partially shown, and 11 represents the improved coke quenching guide. Guide 11 has sides 12 and bottom 13. At roughly a distance of two-thirds of guide 11 measuring away from oven 10, sides 12 diverge and bottom 13 declines. Wedge 14 is preferably disposed to the declined section of bottom 13 to serve as a cleaver, separator, bisector, bificator, etc. in order to open up the coke towards diverging sides 12. Water sprays 15 are provided to sides 12 including the divergent portions of side 12. Sprays 16 are disposed to wedge 14 in order to subject cooling medium to the coke after having been bisected. Conveyance means 17 such as a car receives the coke after having been opened up and cooled.

Bottom 13 adjacent to furnace 10 is provided with opening 18 and equipped with closure 19 so that once the complete body of coke passes opening 18 and the ram head pushing the coke is inside the guide beyond said opening 18, closure 19 is equipped with actuating means 20 to open opening 18 and permit water to run through the bottom of guide 11 and thus prevent water from flowing into oven 10. Sprays 21 are provided at the top of guide 11 to form a curtain of water for suppression of particulate matter. Other embodiments for the separation of the body of coke to get maximum exposure are shown by FIGS. 5 through 11.

In FIGS. 5 and 6 wedge 22 is made up of two sections 23 and 24. Section 23 taking the shape of a plow and section 24 taking the shape of a vertical riser. Wedge 24 is preferably pivotally mounted with built-in cut-out 25 to permit the swinging of wedge 24 when the reactive forces against the ram are excessive.

FIGS. 7 and 8 show sections of wedge 24.

FIGS. 9 and 10 show wedge 26 which is partial in elevation at the exit end of guide 11.

FIG. 11 is another embodiment for separating the coke for maximum exposure. It possesses eccentric 27 which oscillates vibratory leg 28. Leg 18 has lifting bars 29 for physically breaking up the coke at the end of guide 11.

In FIGS. 12 and 13 sprays 30 are provided to spread sheets of water above transport means 17 to suppress particulate matter rising with the vapor from transport 17.

While the operation of the present invention may be comprehended from a study of the foregoing description it is believed that the operation may be further explained as hereinafter set forth:

OPERATION

Figure 4:
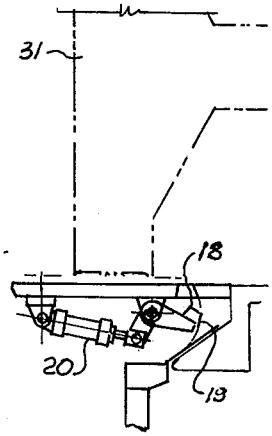
FIG. 4 is a trap door means installed in the bottom of the guide for preventing water from leaking into the oven being quenched.
Figure 1:
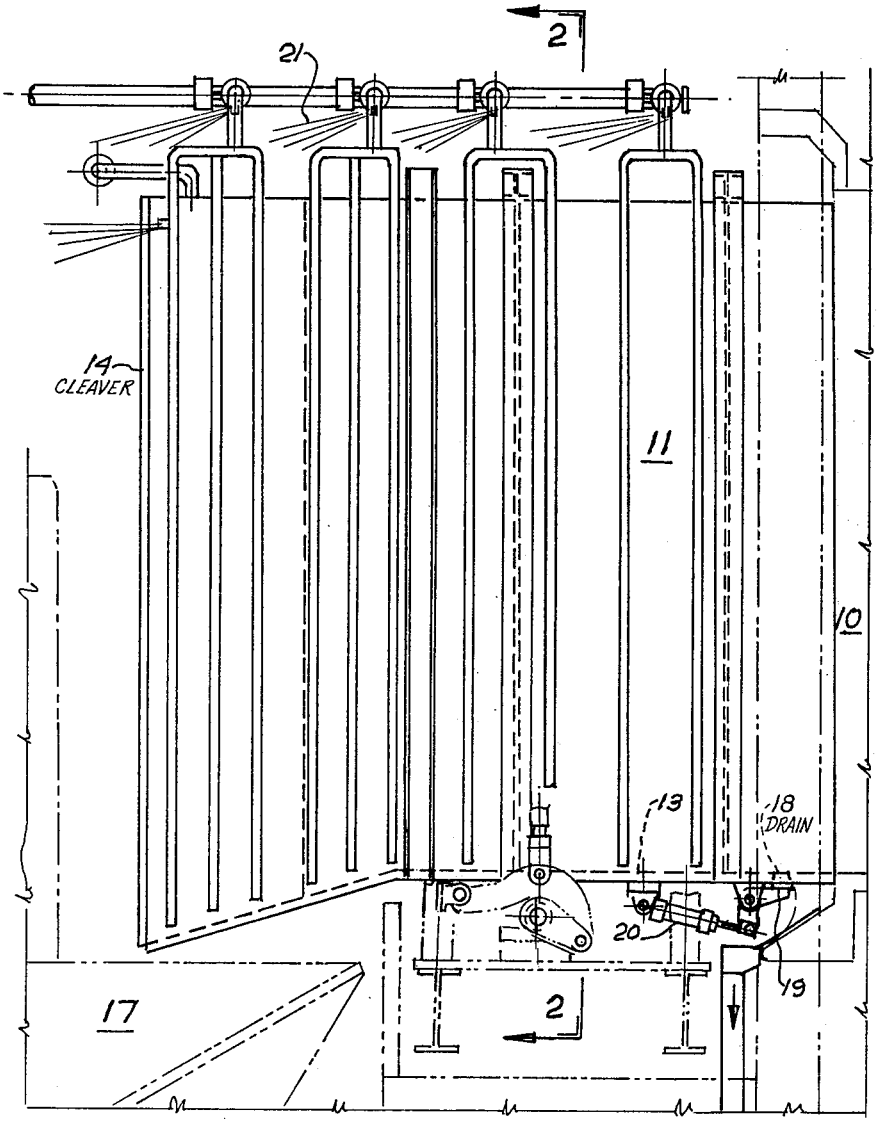
FIG. 1 is a side elevation of the quenching guide showing the conveyance means in phantom and in part. It also shows the means to prevent water from flowing into the oven being pushed, and also, the top sprays for suppression.
Figure 2:
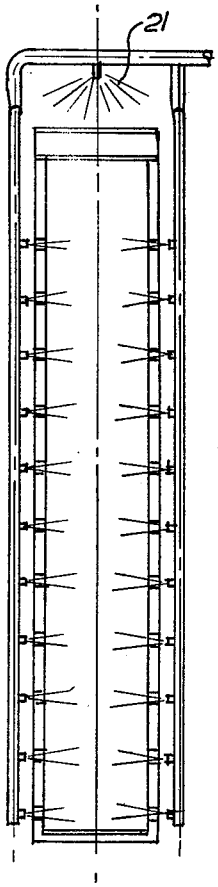
FIG. 2 is a section taken at 2—2 of FIG. 1.

Referring to the drawings, guide 11 is positioned against oven 10 and ram 31 shown in phantom in FIG. 4 pushes the coke through the oven into guide 11. Sprays 15 and 16 are turned on. At the contact of the coke side end of the body of coke against wedge 14 the coke is bifurcated and thusly opened for maximum surface exposure. The divergent sides of the exit end of guide 11 minimize reactive forces of the coke against the sides of the guide as well as the sides of oven 10 and thusly prevent the sticking of the coke inside of oven 10 and/or guide 11.

While the invention has been described in detail, the description and mode of operation described are not intended to limit the invention to the exact description. All variations falling within the purview of the appended claims are also claimed.

I claim:

1. A method of abating smoke during the pushing of coke from the discharge opening of a coke oven, said method including the steps of aligning the inlet portion of a coke guide with the discharge opening of the coke oven and aligning the outlet portion of the guide with a means for receiving and supporting a body of coke which is pushed through the outlet portion of the guide, pushing a body of coke out of the discharge opening of the coke oven and through the outlet portion of the guide with the coke thereafter moving toward the receiving means, directing fluid at coke exiting the guide and moving along a path toward the receiving means for dropping the temperature of the coke, moving a member through at least a portion of the path of movement of the body of coke between the outlet portion of the guide and the receiving means for dispersing portions of the coke exposing substantial areas of coke to the fluid being directed thereat, and confining at least a portion of the gases generated by the directing of fluid toward the coke.

2. A method as defined in claim 1 wherein the step of moving a member through at least a portion of the path of movement of the body of coke moving from the guide toward the receiving means includes the step of pivoting a member at least partially about an axis disposed in fixed position to the path of movement of the body of coke.

3. Apparatus for use in abating smoke during the pushing of coke from the discharge opening of a coke oven and onto a receiving means which receives and supports the body of coke, said apparatus comprising a coke guide having an inlet opening and an outlet portion, means for aligning the inlet portion of the guide with the discharge opening of the coke oven and for aligning the outlet portion of the guide with the receiving means, means for directing fluid at coke exiting the guide and moving toward the receiving means for dropping the temperature of the coke, a coke dispersing member, means for moving said coke dispersing member through at least a portion of the path of movement of the body of coke between the outlet portion of the guide and the receiving means while the coke is moving from the outlet portion of the guide toward the receiving means for dispersing portions of the coke and exposing substantial areas of coke to the fluid being directed thereat, and means for confining at least a portion of the gases generated during the directing of fluid toward the coke.

4. Apparatus as defined in claim 3 wherein said means of moving said coke dispersing member through at least a portion of the path of movement of the body of coke moving from the guide toward the receiving means includes means for pivoting said coke dispersing member at least partially about an axis disposed in fixed position to the path of movement of the body of coke.

* * * * *